US008061055B2

(12) United States Patent
Seidl et al.

(10) Patent No.: US 8,061,055 B2
(45) **Date of Patent: *Nov. 22, 2011**

(54) STEP AIR FOIL WEB STABILIZER

(75) Inventors: Paul Seidl, DePere, WI (US); Michael O. Rocheleau, DePere, WI (US)

(73) Assignee: MegTec Systems, Inc., DePere, WI (US)

( * ) Notice: Subject to any disclaimer, the term of this patent is extended or adjusted under 35 U.S.C. 154(b) by 340 days.

This patent is subject to a terminal disclaimer.

(21) Appl. No.: 11/800,741

(22) Filed: May 7, 2007

(65) Prior Publication Data

US 2008/0276488 A1 Nov. 13, 2008

(51) Int. Cl.
*F26B 13/00* (2006.01)

(52) U.S. Cl. ..... 34/117; 34/124; 34/640; 162/123; 162/166

(58) Field of Classification Search ..... 34/110, 34/114, 117, 120, 123, 124, 640, 90; 162/123, 162/166

See application file for complete search history.

(56) References Cited

U.S. PATENT DOCUMENTS

| | | | | | |
|---|---|---|---|---|---|
| 1,572,585 | A | * | 2/1926 | Walsh | 34/86 |
| 1,602,700 | A | * | 10/1926 | Noun | 34/665 |
| 1,686,680 | A | * | 10/1928 | Case | 34/661 |
| 1,737,015 | A | * | 11/1929 | Merrill | 34/643 |
| 1,743,921 | A | * | 1/1930 | Kerley | 271/211 |
| 1,754,483 | A | * | 4/1930 | Paynter | 34/89 |
| 1,779,611 | A | * | 10/1930 | Merrill | 34/640 |
| 1,779,622 | A | * | 10/1930 | Dreffein | 34/225 |
| 1,802,977 | A | * | 4/1931 | Langsner | 396/579 |
| 1,834,147 | A | * | 12/1931 | Dausmann | 101/424.1 |
| 1,923,106 | A | * | 8/1933 | Mason | 34/614 |
| 1,955,977 | A | * | 4/1934 | Ross | 239/592 |
| 1,980,558 | A | * | 11/1934 | Tandel | 34/655 |
| 2,007,833 | A | * | 7/1935 | Norris | 34/659 |
| 2,132,156 | A | * | 10/1938 | Gessner | 26/18.5 |

(Continued)

FOREIGN PATENT DOCUMENTS

CA 1043728 A1 12/1978

(Continued)

OTHER PUBLICATIONS

Japanese Communication, with complete English translation, dated Oct. 1, 2010 in co-pending foreign patent application No. JP 2007-508337.

(Continued)

*Primary Examiner* — Stephen M Gravini

(74) *Attorney, Agent, or Firm* — Nields, Lemack & Frame, LLC

(57) ABSTRACT

Web stabilizer particularly for one-sided flotation of a running web. The device includes two discharge slots which allow for increased draw down force, which flattens machine direction wrinkles in a floating web. There is a primary discharge slot and a second discharge slot spaced from and stepped down from the primary discharge slot, a first web support surface between the primary discharge slot and the secondary discharge slot, and a second web support surface downstream of the secondary discharge slot in the direction of web travel. An integral blower provides a supply of air that is uniformly distributed to the primary and secondary slots. Air discharged from the primary slot is gathered into the air stream of the secondary slot and creates an increased air cushion to provide greater support to the web and thereby remove machine direction web wrinkles caused by higher tension in light weight webs.

6 Claims, 9 Drawing Sheets

U.S. PATENT DOCUMENTS

| | | | | | |
|---|---|---|---|---|---|
| 2,183,298 | A | * | 12/1939 | Offen | 34/638 |
| 2,269,836 | A | * | 1/1942 | Weiss | 101/416.1 |
| 2,272,383 | A | * | 2/1942 | Poor et al. | 34/655 |
| 2,302,730 | A | * | 11/1942 | Woolford | 134/72 |
| 2,333,236 | A | * | 11/1943 | Dreisel | 34/631 |
| 2,334,854 | A | * | 11/1943 | Zademach | 34/87 |
| 2,422,105 | A | * | 6/1947 | Lehrer | 34/225 |
| 2,492,974 | A | * | 1/1950 | Dungler | 34/643 |
| 2,495,163 | A | * | 1/1950 | Dungler | 26/92 |
| 2,501,875 | A | * | 3/1950 | Rayburn | 34/654 |
| 2,532,910 | A | * | 12/1950 | Hayward | 34/68 |
| 2,558,084 | A | * | 6/1951 | Gwinn | 118/411 |
| RE23,384 | E | * | 7/1951 | Dungler | 26/92 |
| 2,568,695 | A | * | 9/1951 | Bailey | 34/617 |
| 2,574,844 | A | * | 11/1951 | Roden | 34/649 |
| 2,594,299 | A | * | 4/1952 | Dungler | 34/656 |
| 2,597,490 | A | * | 5/1952 | Hurxthal | 34/645 |
| 2,648,089 | A | * | 8/1953 | Mayer | 15/309.1 |
| 2,700,226 | A | * | 1/1955 | Dungler | 34/656 |
| RE24,144 | E | * | 4/1956 | Dungler | 34/656 |
| 2,772,486 | A | * | 12/1956 | Johanson | 34/649 |
| 2,828,552 | A | * | 4/1958 | Brendel et al. | 34/86 |
| 2,838,296 | A | * | 6/1958 | White | 432/41 |
| 2,864,176 | A | * | 12/1958 | Backlert et al. | 34/122 |
| 2,877,564 | A | * | 3/1959 | Leportier | 34/664 |
| 2,916,796 | A | * | 12/1959 | Sibel | 26/92 |
| 2,919,495 | A | * | 1/1960 | Underhay et al. | 34/114 |
| 2,921,411 | A | * | 1/1960 | Black | 65/348 |
| 2,952,078 | A | * | 9/1960 | Litzler | 34/68 |
| 3,013,342 | A | * | 12/1961 | Huber et al. | 34/630 |
| 3,015,168 | A | * | 1/1962 | Johnson et al. | 34/640 |
| 3,046,624 | A | * | 7/1962 | Dietert et al. | 34/612 |
| 3,060,590 | A | * | 10/1962 | Brown | 34/432 |
| 3,060,595 | A | * | 10/1962 | Dapses | 34/654 |
| 3,070,900 | A | * | 1/1963 | Lot | 34/630 |
| 3,071,869 | A | * | 1/1963 | Latimer et al. | 34/114 |
| 3,077,675 | A | * | 2/1963 | Dickens | 34/122 |
| 3,097,994 | A | * | 7/1963 | Dickens et al. | 162/297 |
| 3,119,560 | A | * | 1/1964 | Swancy | 237/56 |
| 3,140,157 | A | * | 7/1964 | Fleissner et al. | 34/115 |
| 3,147,899 | A | * | 9/1964 | Parkes | 226/106 |
| 3,167,408 | A | * | 1/1965 | Justus et al. | 34/122 |
| 3,169,050 | A | * | 2/1965 | Kroon | 34/124 |
| 3,176,411 | A | * | 4/1965 | Jepson et al. | 34/122 |
| 3,176,412 | A | * | 4/1965 | Gardner | 34/122 |
| 3,196,555 | A | * | 7/1965 | Friedel et al. | 34/115 |
| 3,198,499 | A | * | 8/1965 | Stanley | 432/8 |
| 3,199,222 | A | * | 8/1965 | Hultgreen | 34/635 |
| 3,199,224 | A | * | 8/1965 | Brown | 34/643 |
| 3,216,129 | A | * | 11/1965 | Jepson | 34/643 |
| 3,224,110 | A | * | 12/1965 | Kroon | 34/124 |
| 3,242,587 | A | * | 3/1966 | Dupasquier | 34/60 |
| 3,254,426 | A | * | 6/1966 | Lamb et al. | 34/638 |
| 3,284,920 | A | * | 11/1966 | Hayrinen et al. | 34/122 |
| 3,284,922 | A | * | 11/1966 | Goldenberg et al. | 34/637 |
| 3,302,303 | A | * | 2/1967 | Aupoix | 34/145 |
| 3,302,304 | A | * | 2/1967 | Goldenberg et al. | 34/647 |
| 3,305,941 | A | * | 2/1967 | Lloyd | 34/105 |
| 3,308,556 | A | * | 3/1967 | Franklin et al. | 34/207 |
| 3,334,421 | A | * | 8/1967 | Morris | 34/205 |
| 3,374,106 | A | * | 3/1968 | Thygeson, Sr. | 427/209 |
| 3,383,239 | A | * | 5/1968 | Christman, Jr. | 427/542 |
| 3,384,282 | A | * | 5/1968 | Vits | 226/97.3 |
| 3,398,467 | A | * | 8/1968 | Brown | 34/233 |
| 3,417,484 | A | * | 12/1968 | McCarthy | 34/637 |
| 3,417,489 | A | * | 12/1968 | Hardt | 34/655 |
| 3,429,057 | A | * | 2/1969 | Thygeson, Sr. | 34/656 |
| 3,447,247 | A | * | 6/1969 | Daane | 34/122 |
| 3,448,524 | A | * | 6/1969 | Hildebrand | 34/612 |
| 3,452,447 | A | * | 7/1969 | Gardner | 34/643 |
| 3,453,743 | A | * | 7/1969 | Hale | 34/639 |
| 3,498,515 | A | * | 3/1970 | Johnson | 242/615.12 |
| 3,499,233 | A | * | 3/1970 | Black | 34/635 |
| 3,503,134 | A | * | 3/1970 | Fleissner | 28/167 |
| 3,510,113 | A | * | 5/1970 | Wise | 432/64 |
| 3,538,619 | A | * | 11/1970 | Kleiner | 34/647 |
| 3,541,697 | A | * | 11/1970 | Villalobos | 34/115 |
| 3,551,970 | A | * | 1/1971 | Cohn et al. | 6/91 |
| 3,579,853 | A | * | 5/1971 | Martino | 34/218 |
| 3,587,177 | A | * | 6/1971 | Overly | 4/641 |
| 3,589,032 | A | * | 6/1971 | Gretz et al. | 34/662 |
| 3,590,495 | A | * | 7/1971 | Tyson et al. | 34/654 |
| 3,605,992 | A | * | 9/1971 | Weber | 98/484.1 |
| 3,621,586 | A | * | 11/1971 | Vits | 34/60 |
| 3,622,058 | A | * | 11/1971 | Vits | 226/7 |
| 3,629,952 | A | * | 12/1971 | Overly et al. | 34/641 |
| 3,638,330 | A | * | 2/1972 | Stout | 34/643 |
| 3,701,203 | A | * | 10/1972 | Anderson | 34/170 |
| 3,705,676 | A | | 12/1972 | Overly et al. | 226/97 |
| 3,763,571 | A | * | 10/1973 | Vits | 34/641 |
| 3,766,662 | A | * | 10/1973 | Moyer | 34/646 |
| 3,771,239 | A | * | 11/1973 | Minoda et al. | 34/640 |
| 3,810,315 | A | * | 5/1974 | Fleming | 34/655 |
| 3,812,598 | A | * | 5/1974 | Lefebvre et al. | 34/631 |
| 3,823,488 | A | * | 7/1974 | Houben et al. | 34/643 |
| 3,851,408 | A | * | 12/1974 | Lojek et al. | 34/639 |
| 3,874,043 | A | * | 4/1975 | Holm | 26/98 |
| 3,895,449 | A | * | 7/1975 | Chance et al. | 34/638 |
| 3,936,953 | A | * | 2/1976 | Chance et al. | 34/654 |
| 3,957,187 | A | * | 5/1976 | Puigrodon | 226/7 |
| 3,986,274 | A | * | 10/1976 | Holm | 34/653 |
| 3,991,484 | A | * | 11/1976 | Lamb et al. | 34/659 |
| 4,038,152 | A | * | 7/1977 | Atkins | 201/2.5 |
| 4,047,841 | A | * | 9/1977 | Laurin | 416/140 |
| 4,055,003 | A | * | 10/1977 | Sack | 34/632 |
| 4,074,841 | A | * | 2/1978 | Kramer et al. | 226/97.3 |
| 4,085,522 | A | * | 4/1978 | Stroszynski | 34/640 |
| 4,115,052 | A | * | 9/1978 | Flynn | 432/72 |
| 4,122,611 | A | * | 10/1978 | Marchal et al. | 34/73 |
| 4,125,948 | A | * | 11/1978 | Hering et al. | 34/655 |
| 4,133,636 | A | * | 1/1979 | Flynn | 432/72 |
| 4,170,075 | A | * | 10/1979 | Scott | 34/656 |
| 4,219,942 | A | * | 9/1980 | Coliva | 34/203 |
| 4,286,395 | A | * | 9/1981 | Hoersch | 34/636 |
| 4,292,745 | A | * | 10/1981 | Caratsch | 34/644 |
| 4,304,053 | A | * | 12/1981 | Kellerhals et al. | 34/621 |
| 4,308,984 | A | | 1/1982 | Vits | 226/97.35 |
| 4,467,537 | A | * | 8/1984 | Trotscher | 34/635 |
| 4,472,888 | A | * | 9/1984 | Spiller | 34/641 |
| 4,505,053 | A | * | 3/1985 | Andersson et al. | 34/631 |
| 4,523,391 | A | * | 6/1985 | Smith et al. | 34/225 |
| 4,606,137 | A | | 8/1986 | Whipple | 34/156 |
| 4,685,221 | A | * | 8/1987 | Taylor et al. | 34/638 |
| 4,689,895 | A | * | 9/1987 | Taylor et al. | 34/428 |
| 4,718,178 | A | * | 1/1988 | Whipple | 34/640 |
| 4,719,708 | A | * | 1/1988 | Karlsson et al. | 34/636 |
| 4,763,424 | A | * | 8/1988 | Taylor et al. | 34/428 |
| 4,768,695 | A | * | 9/1988 | Stibbe | 242/615.11 |
| 4,777,736 | A | * | 10/1988 | VanOursouw et al. | 34/644 |
| 4,779,358 | A | * | 10/1988 | Atkinson et al. | 34/644 |
| 4,833,794 | A | * | 5/1989 | Stibbe et al. | 34/643 |
| 4,837,947 | A | * | 6/1989 | Krieger | 34/641 |
| 4,848,633 | A | * | 7/1989 | Hagen et al. | 226/97.3 |
| 4,901,449 | A | | 2/1990 | Wimberger | 34/641 |
| 4,905,381 | A | * | 3/1990 | Poterala | 34/634 |
| 4,922,628 | A | * | 5/1990 | Hella | 34/641 |
| 4,932,140 | A | | 6/1990 | Lepisto | 34/641 |
| 4,944,098 | A | * | 7/1990 | Hella et al. | 34/640 |
| 5,016,363 | A | * | 5/1991 | Krieger | 34/641 |
| 5,022,167 | A | * | 6/1991 | Nakamura | 34/655 |
| 5,035,066 | A | * | 7/1991 | Wimberger | 34/641 |
| 5,059,285 | A | * | 10/1991 | Winheim | 162/290 |
| 5,064,979 | A | * | 11/1991 | Jaeger | 219/681 |
| 5,092,059 | A | * | 3/1992 | Wimberger et al. | 34/641 |
| 5,105,558 | A | * | 4/1992 | Curry | 34/449 |
| 5,125,170 | A | * | 6/1992 | Krimsky et al. | 34/640 |
| 5,136,323 | A | * | 8/1992 | Frank et al. | 396/617 |
| 5,147,690 | A | * | 9/1992 | Faust et al. | 427/372.2 |
| 5,155,926 | A | * | 10/1992 | Lymn | 34/638 |
| 5,156,312 | A | * | 10/1992 | Kurie | 242/615.11 |
| 5,181,330 | A | * | 1/1993 | Schoch | 34/659 |
| 5,205,053 | A | * | 4/1993 | Brunner | 34/620 |
| 5,222,309 | A | * | 6/1993 | Ross | 34/632 |
| 5,249,374 | A | * | 10/1993 | Henningsen et al. | 34/213 |
| 5,259,124 | A | * | 11/1993 | Poterala | 34/638 |
| 5,274,892 | A | * | 1/1994 | Strahm | 26/20 |
| 5,282,323 | A | * | 2/1994 | Winheim | 34/629 |

| | | | | | |
|---|---|---|---|---|---|
| 5,285,582 | A | * | 2/1994 | Kouchi et al. | 34/638 |
| 5,287,606 | A | * | 2/1994 | Ruef | 28/219 |
| 5,299,364 | A | | 4/1994 | Heikkila et al. | |
| 5,303,484 | A | * | 4/1994 | Hagen et al. | 34/656 |
| 5,395,029 | A | * | 3/1995 | Kurie | 242/615.11 |
| 5,396,716 | A | * | 3/1995 | Smart et al. | 34/464 |
| 5,659,975 | A | * | 8/1997 | Bahner et al. | 34/459 |
| 5,678,429 | A | * | 10/1997 | Zonco | 68/20 |
| 5,713,138 | A | * | 2/1998 | Rudd | 34/274 |
| 5,749,164 | A | * | 5/1998 | Bowden | 34/641 |
| 5,775,002 | A | * | 7/1998 | Iwase et al. | 34/122 |
| 5,797,327 | A | | 8/1998 | Gieser et al. | 101/483 |
| 5,836,084 | A | * | 11/1998 | Jackson et al. | 34/107 |
| 5,970,626 | A | * | 10/1999 | Schmidt et al. | 34/631 |
| 5,970,627 | A | * | 10/1999 | Stenz et al. | 34/633 |
| 6,021,583 | A | * | 2/2000 | Stelljes et al. | 34/618 |
| 6,085,437 | A | * | 7/2000 | Stipp | 34/115 |
| 6,092,304 | A | * | 7/2000 | Karlsson et al. | 34/640 |
| 6,108,931 | A | * | 8/2000 | Schmidt et al. | 34/216 |
| 6,131,308 | A | * | 10/2000 | Kramer et al. | 34/633 |
| 6,155,518 | A | * | 12/2000 | Bannenberg | 242/615.11 |
| 6,158,144 | A | * | 12/2000 | Weber et al. | 34/335 |
| 6,231,001 | B1 | * | 5/2001 | Kramer et al. | 242/615.11 |
| 6,240,654 | B1 | * | 6/2001 | Weber et al. | 34/335 |
| 6,289,607 | B1 | * | 9/2001 | Aaltonen et al. | 34/508 |
| 6,325,896 | B1 | | 12/2001 | Hultcrantz et al. | 162/289 |
| RE37,557 | E | * | 2/2002 | Bahner et al. | 34/459 |
| 6,382,100 | B1 | * | 5/2002 | Satoh et al. | 101/212 |
| 6,393,719 | B1 | * | 5/2002 | Stipp | 34/115 |
| 6,397,488 | B1 | * | 6/2002 | Brinkly | 34/92 |
| 6,397,495 | B1 | * | 6/2002 | Doherty et al. | 34/641 |
| 6,425,271 | B1 | * | 7/2002 | Vinas | 68/177 |
| 6,473,990 | B1 | * | 11/2002 | Trokhan et al. | 34/114 |
| 6,581,298 | B1 | * | 6/2003 | Catallo | 34/231 |
| 6,581,302 | B1 | * | 6/2003 | Philipp et al. | 34/633 |
| 6,598,315 | B1 | | 7/2003 | Heikkila et al. | 34/461 |
| 6,637,128 | B2 | * | 10/2003 | Kuroiwa et al. | 34/629 |
| 6,694,639 | B2 | * | 2/2004 | Hanaya | 34/115 |
| 6,699,365 | B2 | * | 3/2004 | Duan | 162/207 |
| 6,735,883 | B1 | * | 5/2004 | Bria et al. | 34/444 |
| 6,742,285 | B2 | * | 6/2004 | Shepard | 34/611 |
| 6,775,925 | B2 | * | 8/2004 | Zagar et al. | 34/618 |
| 6,990,751 | B2 | * | 1/2006 | Riley et al. | 34/506 |
| 7,020,983 | B2 | * | 4/2006 | Bolduan et al. | 34/506 |
| 7,241,003 | B2 | * | 7/2007 | Fellingham et al. | 347/102 |
| 7,530,179 | B2 | * | 5/2009 | Rocheleau | 34/640 |
| 2003/0094254 | A1 | * | 5/2003 | Duan | 162/207 |
| 2003/0145481 | A1 | * | 8/2003 | Zagar et al. | 34/83 |
| 2005/0034323 | A1 | * | 2/2005 | Naruoka | 34/618 |
| 2005/0150130 | A1 | * | 7/2005 | Fellingham et al. | 34/624 |
| 2005/0223593 | A1 | * | 10/2005 | Rocheleau | 34/638 |
| 2008/0276488 | A1 | * | 11/2008 | Seidl et al. | 34/623 |
| 2009/0288311 | A1 | * | 11/2009 | Da Silva et al. | 34/444 |

FOREIGN PATENT DOCUMENTS

| | | | | |
|---|---|---|---|---|
| CA | 2010130 | A1 | | 8/1990 |
| CA | 2077514 | A1 | | 3/1993 |
| DE | 3587177 | A1 | * | 4/1993 |
| EP | 0291832 | A1 | | 11/1988 |
| EP | 0541106 | A1 | | 5/1993 |
| GB | 2058313 | A | * | 4/1981 |
| JP | 52-012476 | B | | 4/1977 |
| JP | 60-232359 | A | | 11/1985 |
| JP | 02154973 | A | * | 6/1990 |
| JP | 04245245 | A | * | 9/1992 |
| JP | 6-220792 | A | | 8/1994 |
| JP | 2000-230782 | A | | 8/2000 |
| JP | 2001-004274 | A | | 1/2001 |

OTHER PUBLICATIONS

International Search Report dated Jul. 18, 2008 in corresponding foreign patent application No. PCT/US2008/002972.

International Preliminary Report on Patentability dated Nov. 10, 2009 in corresponding foreign patent application No. PCT/US2008/002972.

International Search Report and Written Opinion of the International Searching Authority dated May 12, 2005 in co-pending foreign patent application No. PCT/US05/05606.

International Preliminary Report on Patentability dated Feb. 2, 2006 in co-pending foreign patent application No. PCT/US05/05606.

Russian Communication, with English translation, dated Aug. 10, 2010 in co-pending foreign patent application No. 2006139962.

Australian Communication dated Jul. 3, 2009 in co-pending foreign patent application No. 2005236397.

English translation of Korean Communication dated Jun. 13, 2008 in co-pending foreign patent application No. 10-2006-7019388.

Chinese Communication, with English translation, dated Aug. 8, 2008 in co-pending foreign patent application No. 200580011072.5.

Chinese Communication, with English translation, dated Sep. 18, 2009 in co-pending foreign patent application No. 200580011072.5.

Japanese Communication, with partial English translation, dated Oct. 1, 2010 in co-pending foreign patent application No. JP 2007-508337.

Canadian Communication dated Apr. 6, 2010 in co-pending foreign patent application No. 2,556,898.

English translation of Taiwanese Communication dated Jun. 28, 2011 in corresponding Taiwanese Patent Application No. 097115815.

* cited by examiner

STEP AIR FOIL WEB STABILIZER

FIELD OF THE INVENTION

The present invention relates to devices and methods for contactlessly drying and guiding traveling webs, and more particularly, an improved web air flotation device that minimizes, eliminates or removes web wrinkles.

BACKGROUND OF THE INVENTION

In web coating, printing and drying operations, it is often desirable that the web have contactless support, in order to avoid damage to the web itself or to the coating (such as ink) previously applied to one or more surfaces of the web. One conventional arrangement for contactlessly supporting a web during drying includes horizontal upper and lower sets of air bars between which the web travels. Hot air issuing from the air bars both dries and supports the web as it travels through the dryer.

Important characteristics of any flotation system are the amount of cushioning provided by the flotation device, and the stability of the web as it passes over the device. Adequate support removes web wrinkles that typically are caused by higher tensions in lightweight webs. Airflow instabilities near the web can induce web flutter and subsequent web contact with mechanical parts of the dryer, resulting in coating disturbance or web damage. Web flutter can be manifested in a multitude of forms, ranging from a violent flapping of the web to a high frequency drumming.

Single slot air bars are known in the art as air foils. They differ from opposing double and triple slot air bars in that they have both a positive and negative pressure on the face of the air bar, whereas the double and triple slotted bars have only positive pressure. As a result, double and triple slotted air bars can be operated over a wider range of pressures and clearances; typical flotation clearances of air foils being about 2.3 mm compared to 6.3 mm for double and triple air bars. Air foils also have a dramatic decrease in both heat transfer and flotation stability as clearance is increased, whereas the heat transfers for double and triple air bars are relatively stable up to a clearance of 25 mm (single size bar). A typical application for single slot air bars is where flotation must be accomplished with air on only one side of the web.

Conventional air foils discharge air at about 45° to the web, which pushes the web up and relies on the flatness of the web to trap the air and force it to follow the air foil face. This creates a negative pressure to pull the web back down and hold it in place over the air foil. When floating lightweight webs under medium to high tensions, machine direction corrugations will form in the web. These corrugations allow the discharged air from the 45° slot to escape and not trap the air between the air foil face and the web, thereby reducing or eliminating the velocity created to draw the web down to the air foil face. This can result in poor flotation and can render the air foil ineffective.

The present invention relates to a device which discharges an air flow through a primary and secondary air slot or orifice for the purpose of one-sided flotation and stabilization of a moving web.

SUMMARY OF THE INVENTION

The problems of the prior art have been overcome by the present invention, which provides a step air foil web stabilizer having an integral blower for one-sided non-contact flotation of a running web, particularly suitable for supporting and/or stabilizing a moving web traveling from a printing press to a web dryer. The stabilizer design includes two discharge slots which allow for increased draw down force, which flattens machine direction wrinkles in a floating web. The design does not rely on a flat web to help create a cross-face velocity to draw the web to the face for proper flotation as in conventional air foil designs. Air discharged from the primary slot is gathered into the air stream of the secondary slot and creates an increased air cushion to provide greater support to the moving web and thereby remove machine direction web wrinkles caused by higher tension in light weight webs, and creates a higher flotation height for higher tensioned webs. The two air discharge slots blow gas (air) parallel to the web over a longer area than conventional designs thereby increasing the draw down force against the web. A constant or substantially constant air velocity is maintained across the flat face of the device for maximum draw down force. Incorporating a secondary slot that discharges air parallel to the web maintains a constant pull down force that is not dependent on a flat web on one-sided flotation applications. Two large flat face areas create a draw down force that is about twice that of conventional devices.

The stabilizer includes a primary discharge slot and a second discharge slot spaced from and stepped down from the primary discharge slot, a first web support surface between the primary discharge slot and the secondary discharge slot, and a second web support surface downstream of the secondary discharge slot in the direction of web travel. The stabilizer includes an integral air supply which provides a supply of air that is uniformly distributed to the primary and secondary slots.

The web stabilizer can be primarily used for one-sided flotation, but also can be used with two sided arrangements for enhancement of drying. It is particularly suited for placement between the last printing unit of a press and the entry slot of a web dryer.

DETAILED DESCRIPTION+ OF THE INVENTION

The web stabilizer incorporates a secondary slot that discharges air parallel to the web in order to maintain a constant pull down force that is independent of a flat web. It is particularly useful for one-sided flotation applications (an opposing air bar is not necessary), particularly above the web, although placement below the web is also contemplated and within the scope of the present invention. Air discharged from the primary slot (the first slot encountered by the traveling web as it travels over the device) is reclaimed and gathered in the air stream of the downstream (in the direction of web travel) secondary slot, and an enhanced air cushion is created to provide greater support to the moving web, which in turn removes machine direction web wrinkles such as those caused by higher tensions in light weight webs. One-sided flotation and flattening of a wide range of web weights is achieved, from thin films to heavier paper and films. The working window of operation with different web weights is over twice that of prior art air foils. The device does not rely on a flat web to help create a cross face velocity to draw the web to the face for proper flotation of the web as in the prior art; the downstream secondary face discharging parallel to the web creates a draw down force without the presence of a web. The increased cushion pressure of the secondary slot and the reclaimed air from the primary upstream slot stretches or spreads the web, removing any machine direction wrinkles that may have formed in the web, creating a glass-like appearance.

Figure 1:
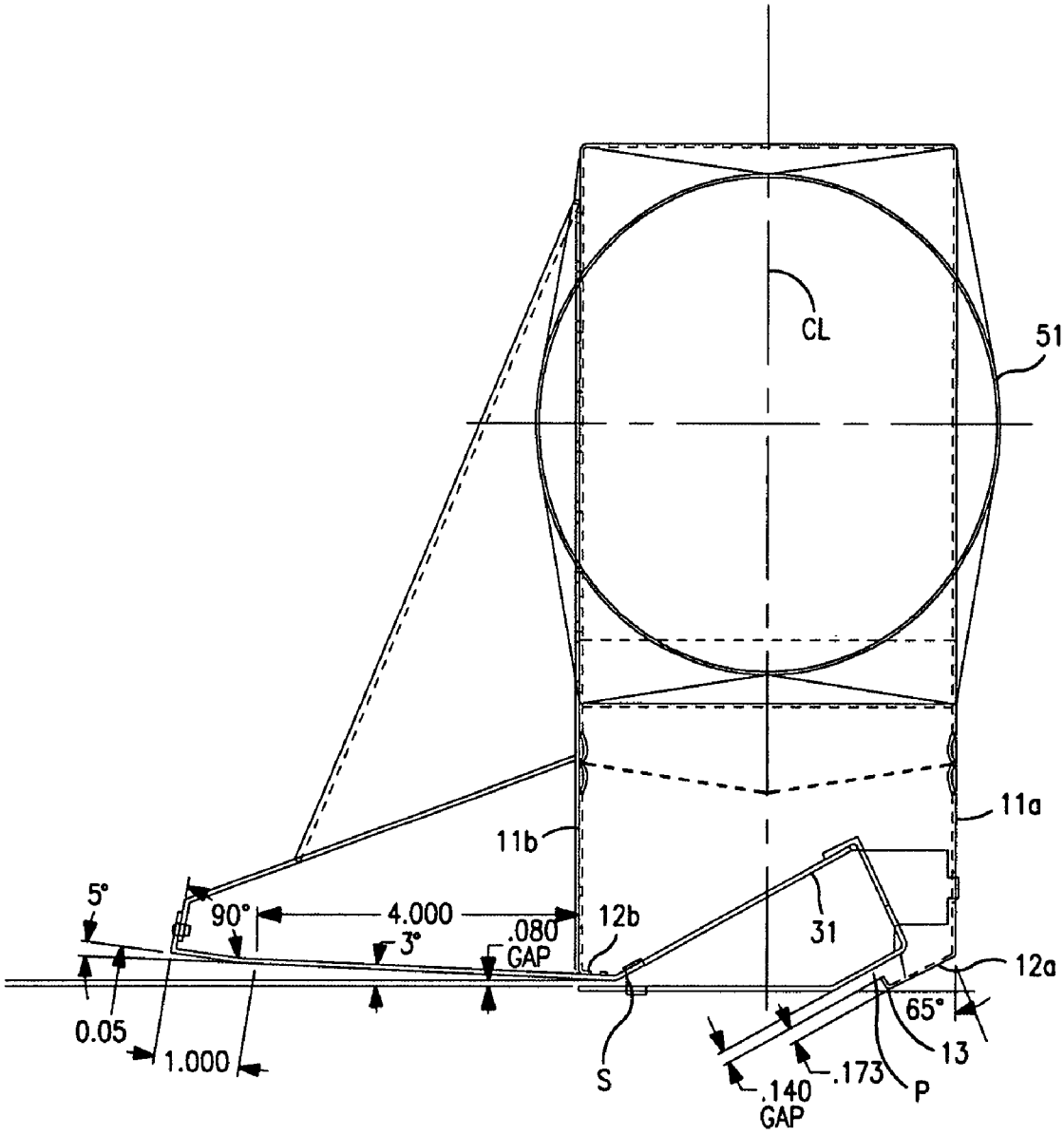
FIG. 1 is a cross-sectional view of a web stabilizer in accordance with certain embodiments.
Figure 9:
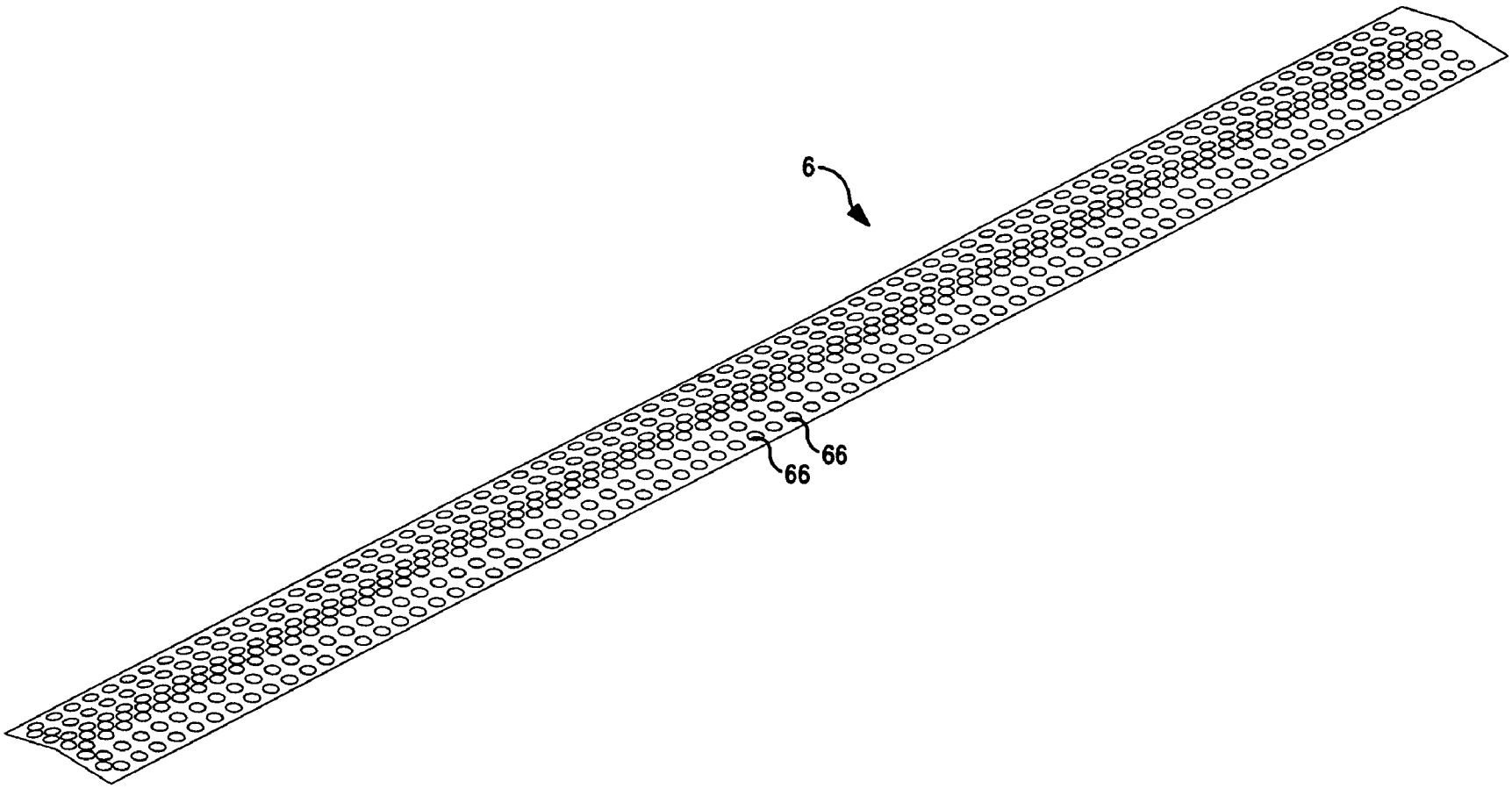
FIG. 9 is an isometric view of a diffuser plate in accordance with certain embodiments.

Turning now to FIG. 1, there is shown a step air foil web stabilizer in accordance with an embodiment of the invention generally at 10. The stabilizer 10 is defined in part by a header 1, which in the embodiment shown, is generally rectangular in cross-section except for its top portion. Opposite sides 11*a*, 11*b* of header 1 terminate in respective top flange portions 12*a*, 12*b*. Top flange portion 12*a* is angled, preferably at about 65° relative to vertical, and terminates in a bent portion 13. Top flange portion 12*b* extends towards opposite side 11*a* in a substantially horizontal fashion. The header 1 defines an interior space 5 that serves as a plenum for the gas that is received via the integral blower. A diffuser plate 6, as seen in FIG. 9, having a plurality of spaced apertures 66 can be positioned in the header to help distribute the supply of gas evenly as it flows towards the discharge slots. In the embodiment shown, the diffuser 6 has a pitch (about 15°) with an apex at or near the centerline CL of the header 1.

Figure 3A:
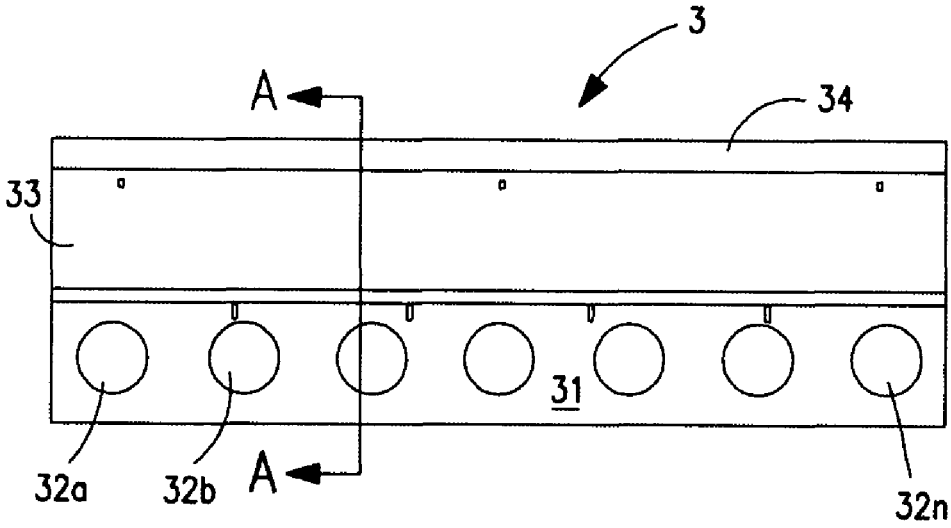
FIG. 3A is a top view of the trailing bottom plate of the web stabilizer in accordance with certain embodiments.
Figure 3B:
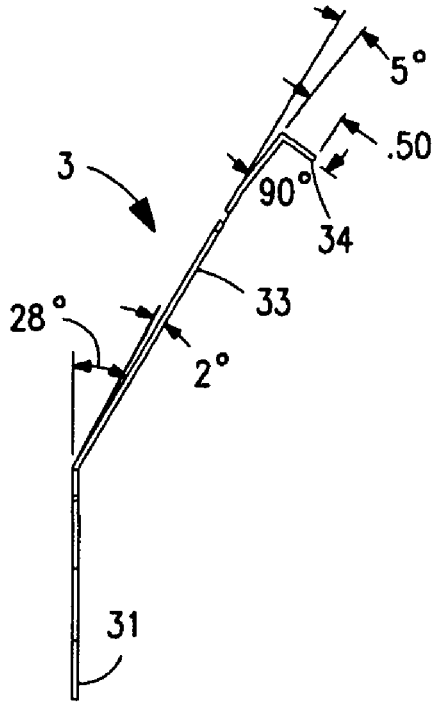
FIG. 3B is a cross-sectional view of the trailing bottom plate taken along line A-A of FIG. 3A.
Figure 3C:
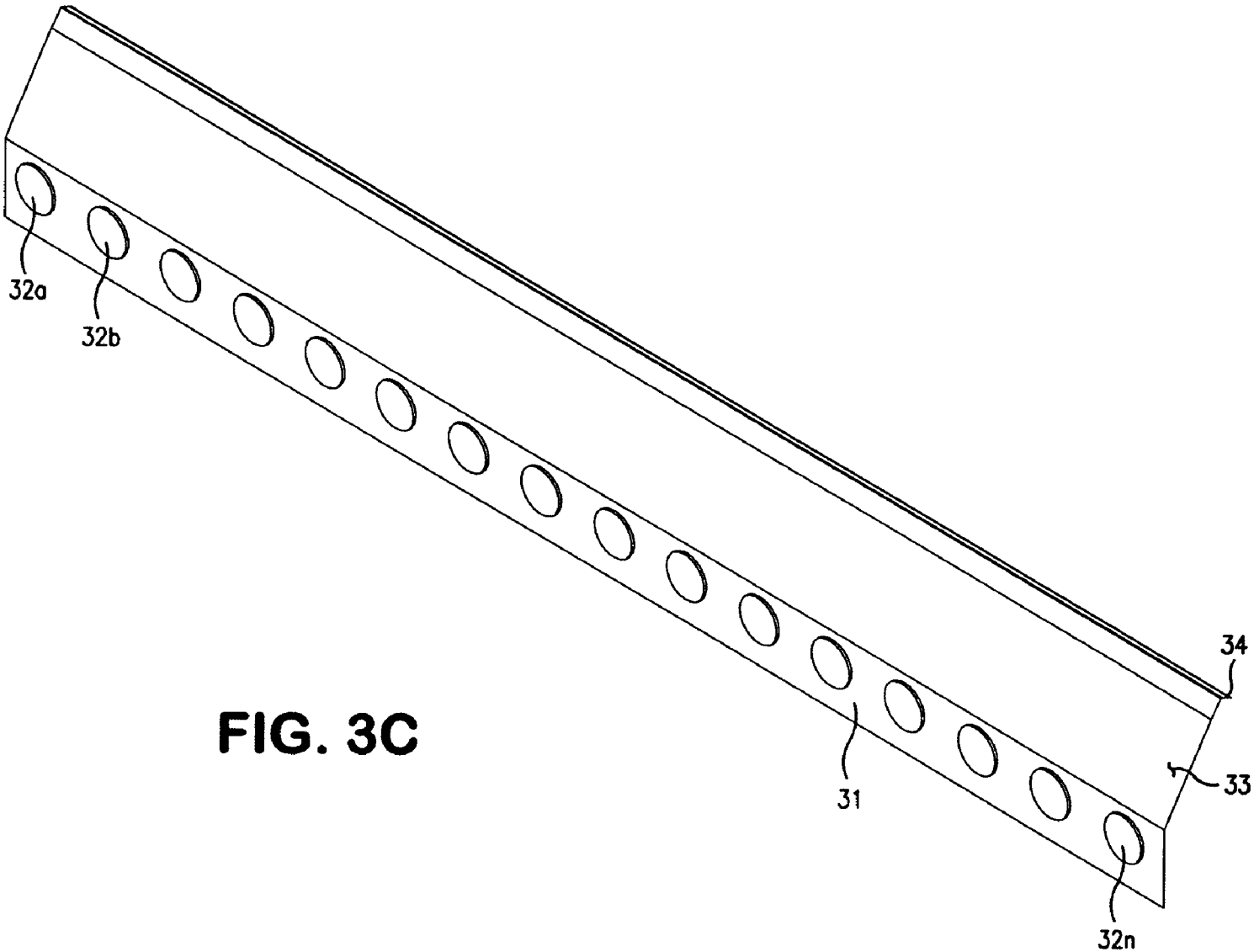
FIG. 3C is a perspective view of the trailing bottom plate of FIG. 3A.

The flange portions 12*a*, 12*b* and bent portion 13 of header 1, together with the trailing top plate 2 and trailing bottom plate 3, define the primary and secondary slots of the device 10. Specifically, FIGS. 3A, 3B and 3C illustrate the trailing bottom plate 3 in greater detail. The plate 3 includes a relatively short portion 31 that has a plurality of spaced apertures 32*a*-32*n* formed therein. Preferably the apertures are circular and are evenly spaced to allow for even flow of gas from the plenum to the stepped-down secondary slot of the air foil, as discussed in greater detail below. In the embodiment shown, there are six such apertures, each about 2 inches in diameter, although those skilled in the art will appreciate that the present invention is not limited to any particular number or size aperture.

Figure 6:
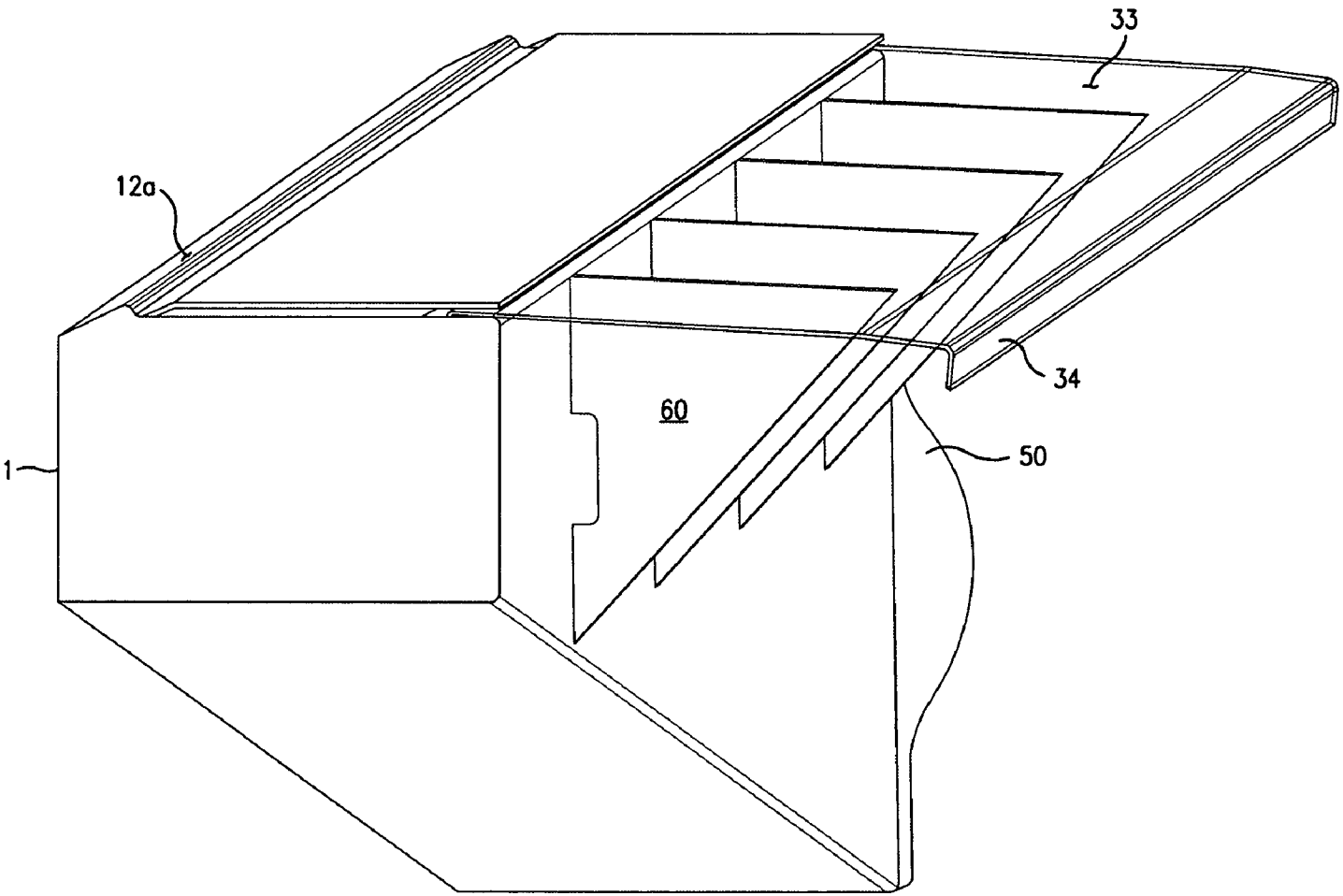
FIG. 6 is another perspective view of the web stabilizer in accordance with certain embodiments.

The plate 3 also includes a relatively long portion 33 that extends from the short portion 31 at an angle therefrom. The relatively long portion 33 forms the wing of the air foil, as best seen in FIG. 6, and terminates in a downwardly extending flange 34. Preferably the relatively long portion 33 of the plate 3 extends from the short portion 31 at an angle of about 28°, bends an additional 2-3° towards the midpoint of the portion 33, and then bends an additional 5° about one inch from the flange 34. The flange 34 extends downwardly at a right angle about 0.5 inches. The plate 3, together with trailing top plate 2, defines the secondary slot S through which air flowing from the apertures 32*a*-32*n* is emitted. That air then travels along the top face of the wing in the direction of web travel.

Figure 4:
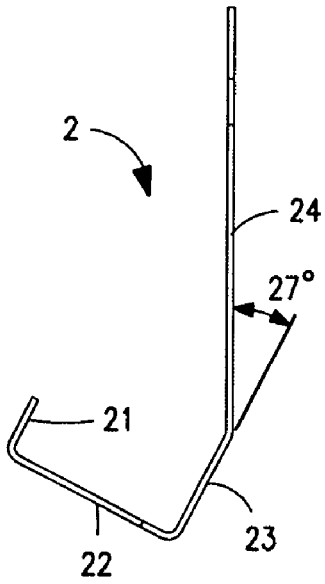
FIG. 4 is a cross-sectional view of the trailing top plate of the web stabilizer in accordance with certain embodiments.

FIG. 4 illustrates the trailing top plate 2 in cross-section. The top plate 2 includes a flange 21 that connects to the end of the short portion 31 of the trailing bottom plate 3, such as by welding (see FIG. 1). Extending from flange 21 is a first flat portion 22, a second flat portion 23 which extends from flat portion 22 at an angle of approximately 90°, and an elongated portion 24 that extends from second flat portion 23 at an angle of about 27°. When properly positioned in the header 1, the second flat portion 23 of the trailing top plate 3 defines with flange 13 of the header 1 the primary slot P, and the elongated portion 24 defines a top web support face of the air foil 10 (best seen in FIG. 1) along which the air exiting from the primary slot P flows in the direction of web travel. Preferably the discharge opening of the primary slot P is about 0.08 inches.

The distance between the primary slot P and the secondary slot S is important for proper air flow and web flotation. If the distance is too small, the air issuing from the primary slot P will not flow parallel to the web. If the distance is too great, the primary slot airflow will lose its velocity. Preferably the distance between the slots is from about 2.5 inches to about 6.5 inches, with 3.25 inches particularly preferred.

Figure 5:
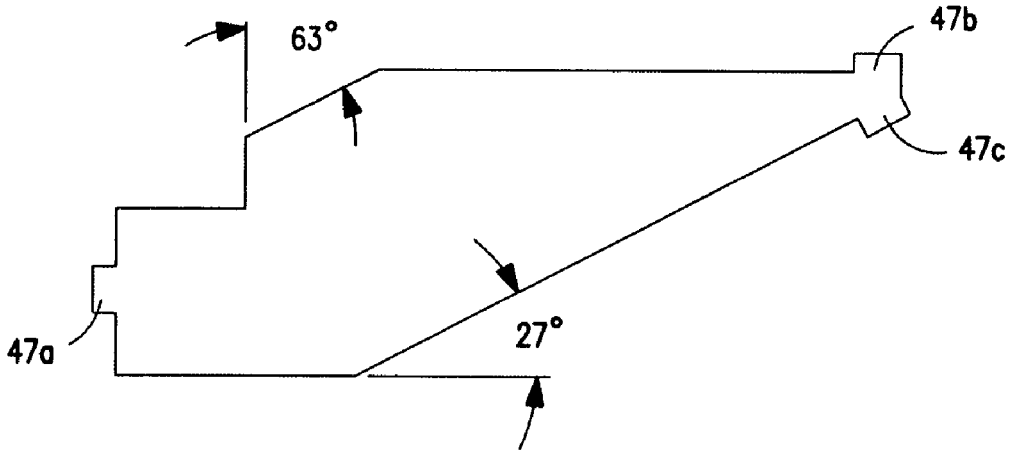
FIG. 5 is a cross-sectional view of a spacer for the web stabilizer in accordance with certain embodiments.

Turning now to FIG. 5, there is shown in cross-section a spacer 4. The spacer 4 is shaped to be received within the space defined by the top and bottom trailing plate assemblies. Preferably a plurality of spacers 4 are positioned along the length of the air foil, and are positioned between the apertures in the trailing bottom plate 3 so as not to interfere with the flow of gas emanating from the apertures 32*a*-32*n*. The spacing across the length is not critical, as they merely form a truss system for strength. The cross-sectional shape of the spacers 4 matches the cross-section of the area defined by the trailing top and bottom plates 2 and 3, respectively. The spacers 4 can be secured in place by any suitable means, and are preferably secured via welding of the tab 47*a* to the header 1, tab 47*b* to the trailing top plate 2, and tab 47*c* to the trailing bottom plate 3. The spacer ends set the gap or opening size for the secondary slot S, which is preferably about 0.08 inches. The secondary slot S discharges air parallel to the web and maintains a constant air velocity across the flat face for maximum draw down force.

Figure 7:
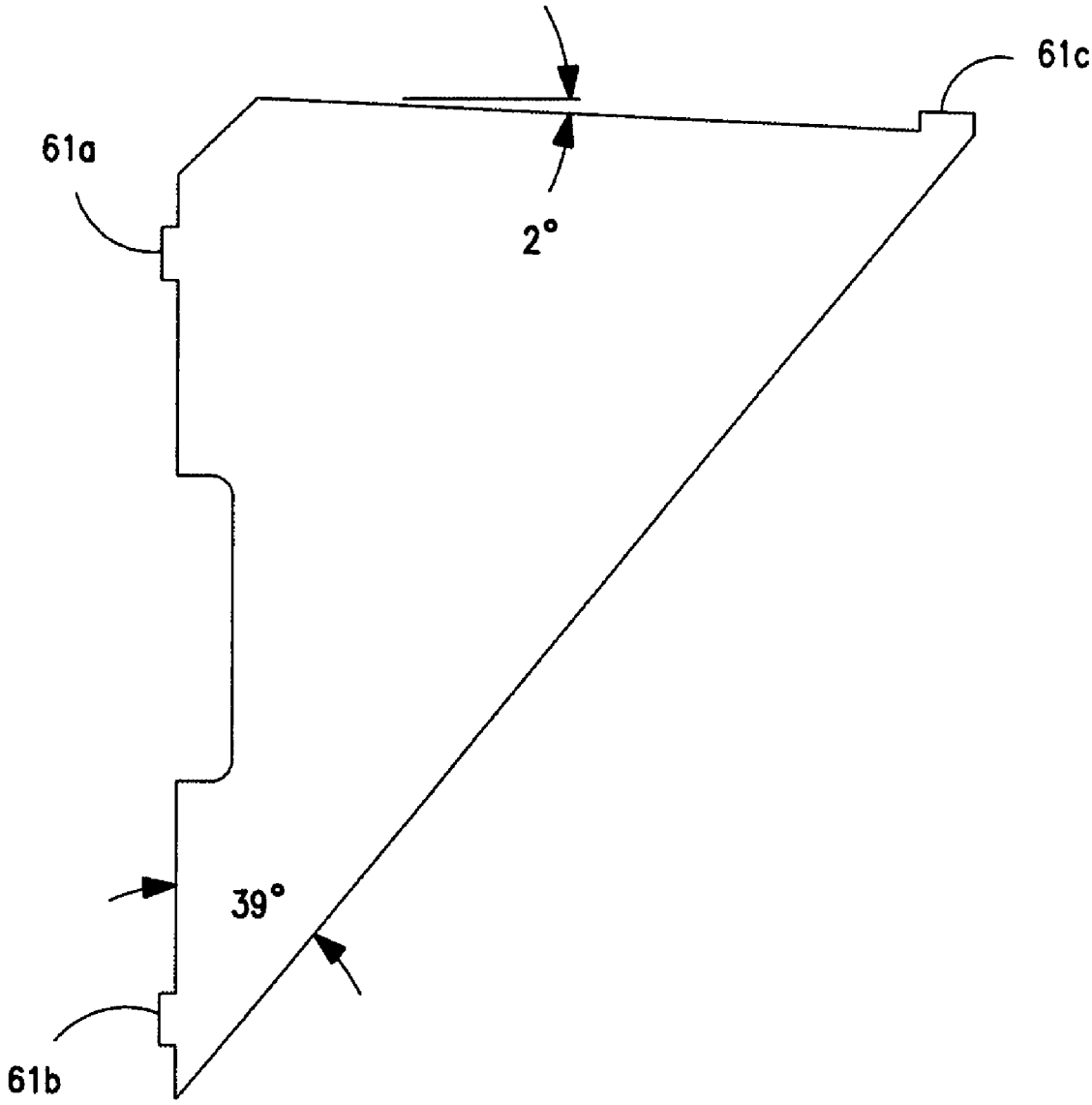
FIG. 7 is a cross-section view of a gusset for the web stabilizer in accordance with certain embodiments.

In order to adequately support the wing extension of the trailing bottom plate, a plurality of gussets 60 (FIG. 7) are positioned beneath the wing as shown in FIG. 6. Each gusset 60 attaches to the header 1 by suitable means, such as by welding at tabs 61*a*, 61*b*. Similarly, the top of the gusset 60 attaches to the underside of the wing via welding of tab 61*c*. The top of each gusset 60 is tapered to accommodate the slope of the wing. The number of gussets needed depends upon the length of the nozzle, and is within the skill in the art. In the embodiment shown in FIG. 6, four evenly spaced gussets are provided.

Figure 2:
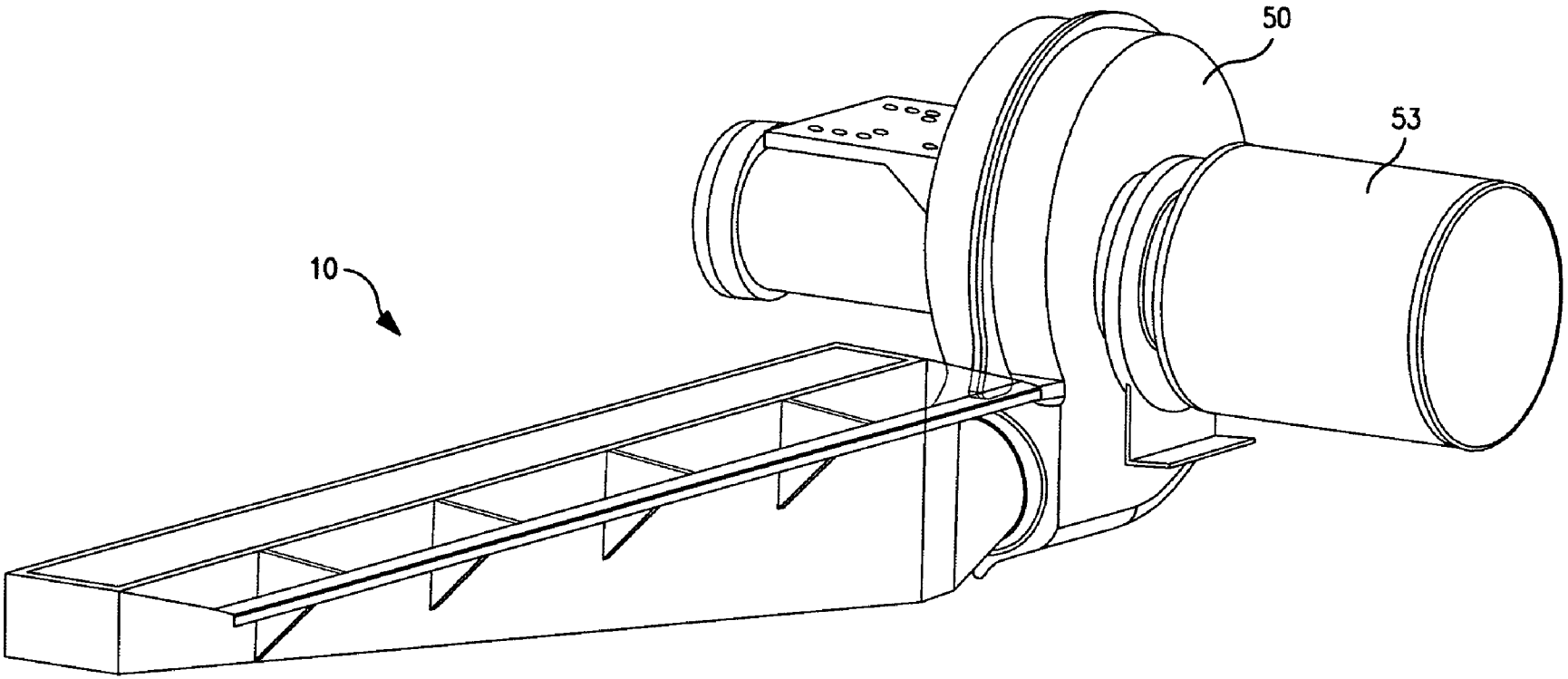
FIG. 2 is a perspective view of the web stabilizer in accordance with certain embodiments.
Figure 8:
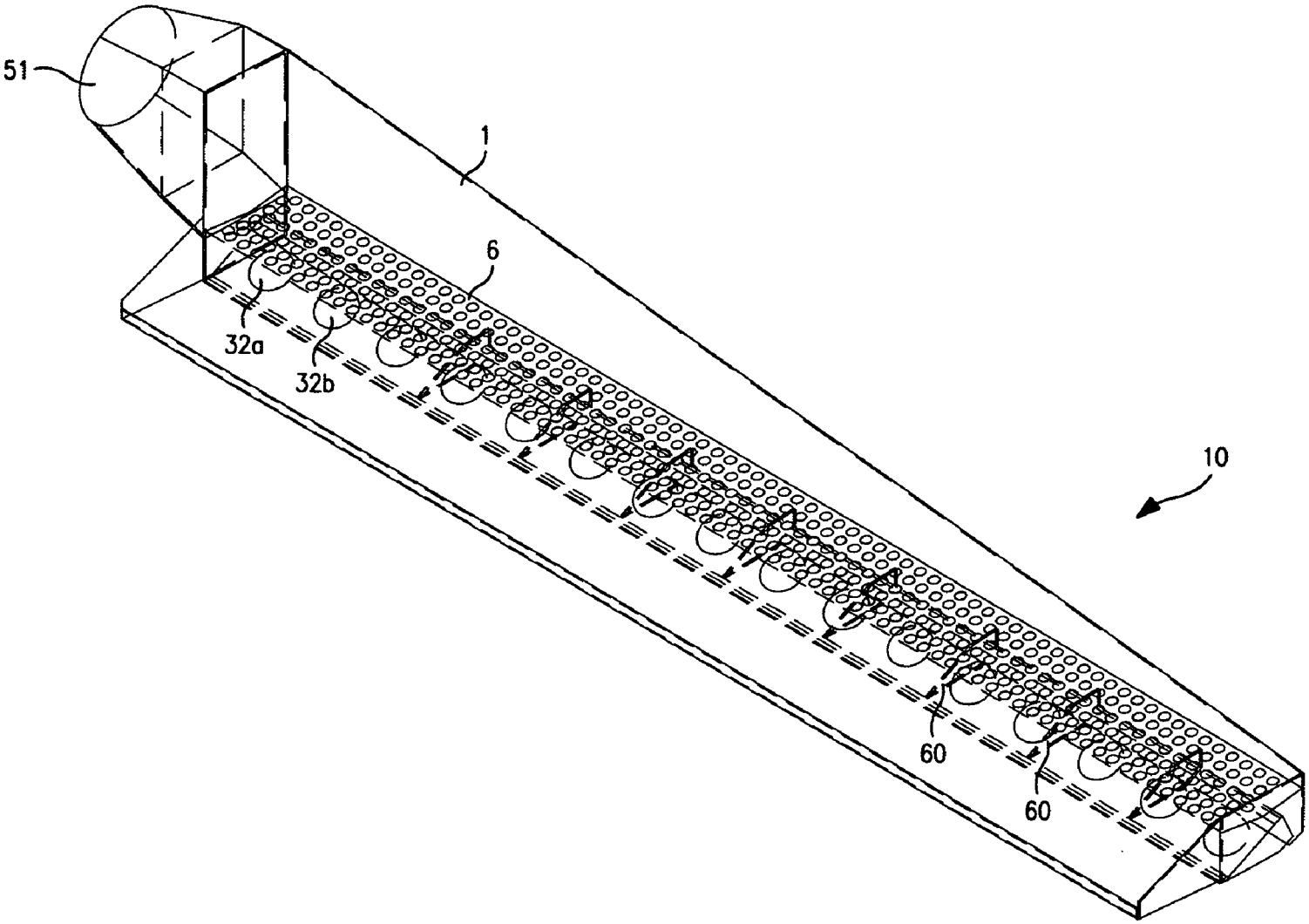
FIG. 8 is an isometric view of the web stabilizer in accordance with certain embodiments.

As can be seen in FIGS. 2, 6 and 8, the stabilizer header 1 expands outwardly toward the blower 50. An inlet aperture 51 is provided to allow communication between the blower 50 and the primary and secondary discharge slots of the stabilizer. Preferably the inlet aperture 51 is circular in cross-section, as best seen in FIGS. 1 and 8. The blower is driven by electric motor 53. Because the source of air is attached directly to the unit and no additional duct work is required, the unit is portable and can be easily mounted.

The increased hold down force of the device creates a flat web for a stable transition into opposing air bar zones without web flutter, web billowing, or marking problems.

Thus, in operation, air flow from the integral blower 50 is discharged through primary and secondary slots or orifices. The design allows for the reclamation of the discharged air from the primary slot to be gathered into the air stream of the secondary slot and create an increased air cushion to give greater support to the moving web, which in turn removes the machine direction web wrinkles caused by higher tensions in lighter weight webs. A higher flotation height (e.g., a positive 0.125 inch flotation height off the air foil face regardless of line speed) is possible for higher tensioned webs. Because air is discharged below and parallel to the web, there is always a velocity across the air foil face to draw the corrugated web down to the face and hold it in place for controlled transport. The increased cushion pressure of the secondary slot stretches the web, removing any machine direction wrinkles that may have formed in the web, thereby creating a glass-like appearance to the web. By incorporating two discharge slots on two different face locations and thus providing two large flat face areas, the draw down force is doubled, which is a necessity when flattening machine direction corrugation wrinkles. Conventional air foils discharge air at about 45° to the web, which pushes the web up and relies on the flatness of the web to trap the air and force it to follow the air foil face, which in turn creates a negative pressure to pull the web back down and hold it in place over the air foil. When floating light weight webs under medium to high tensions, machine direction corrugations tend to form in the web, which allow the discharged air from the 45° slot to escape through the corrugations and not trap the air between the air foil face and the web. As a result, there is no velocity created to draw the web down to the air foil face. Since the instant web stabilizer discharges the air parallel to the web through a primary and secondary slot with the secondary slot being downstream of the primary slot in the direction of web travel, there is always a velocity across the step air foil web stabilizer face to draw the corrugated web down to the step air foil web stabilizer face and hold the web in place. By incorporating the primary and secondary discharge slots on two different step foil face heights and also increasing the length of the face compared to conventional air foil designs, the draw down force is approximately doubled and machine direction corrugations wrinkles can be flattened.

The range of web weights and tension conditions with which the present invention exhibits excellent flotation characteristics is more than twice that of conventional designs.

The device is particularly useful between the last printing unit of a printing press and the entry of the dryer. It is also useful downstream of the dryer in industrial units, and in optical film applications where the use of idler rolls is undesirable.

What is claimed is:

1. In a printing press and dryer combination, a web stabilizer positioned between said printing press and dryer for floating a web of material exiting said printing press and entering said dryer, comprising a primary discharge orifice and a second discharge orifice stepped down from said primary discharge orifice and downstream thereof in the direction of web travel, a first web support surface between said primary discharge orifice and said secondary discharge orifice, a second web support surface downstream of said secondary discharge orifice in the direction of web travel, and an integrated blower for supplying air to said primary and secondary discharge orifices.

2. The printing press and dryer combination of claim 1, wherein said first web support surface is flat.

3. The printing press and dryer combination of claim 1, wherein said secondary discharge orifice of said web stabilizer discharges air parallel to the web.

4. The printing press and dryer combination of claim 1, wherein air discharged from said primary discharge orifice of said web stabilizer is gathered into the air stream of said secondary discharge orifice in a direction parallel to the web transport direction.

5. The printing press and dryer combination of claim 1, wherein said second web support surface comprises a wing portion that slopes downwardly as it extends away from said secondary discharge orifice.

6. The printing press and dryer combination of claim 1, wherein said web stabilizer further comprises a diffuser for uniformly distributing air to said primary discharge orifice and to said secondary discharge orifice.

* * * * *